US006044491A

United States Patent [19]

Emery

[11] Patent Number: 6,044,491

[45] Date of Patent: Apr. 4, 2000

[54] UNDERGARMENT DRESSING AID

[76] Inventor: Sylvia N. Emery, 521 W. San Remo, Gilbert, Ariz. 85233

[21] Appl. No.: 09/224,305

[22] Filed: Dec. 31, 1998

[51] Int. Cl.[7] ..... A41B 1/00

[52] U.S. Cl. ..... 2/69; 2/78.1; 2/46

[58] Field of Search ..... 2/46, 69, 73, 78.1; 450/97, 112, 116, 152, 153

[56] References Cited

U.S. PATENT DOCUMENTS

| | | | |
|---|---|---|---|
| Re. 26,021 | 5/1966 | Uer et al. | 450/112 |
| 1,532,823 | 4/1925 | Kirby | 450/112 |
| 2,009,001 | 7/1935 | Gribbon | 450/112 |
| 2,113,663 | 4/1938 | Newman et al. | 2/46 |
| 2,555,974 | 6/1951 | Kattermann | 450/112 |
| 2,810,129 | 10/1957 | Sebrell | 450/112 |
| 2,896,216 | 7/1959 | Spewak | 2/46 |
| 3,310,052 | 3/1967 | Ward, Jr. | 450/112 |
| 3,401,699 | 9/1968 | Shea | 450/112 |

*Primary Examiner*—Gloria M. Hale

[57] ABSTRACT

A undergarment dressing aid for aiding a user when putting on undergarments and lingerie with hard to reach fasteners. The undergarment dressing aid includes a tubular sleeve designed for wear around a user's torso and having inner and outer faces and open top and bottom ends.

11 Claims, 2 Drawing Sheets

UNDERGARMENT DRESSING AID

BACKGROUND OF THE INVENTION

1. Field of the Invention

The present invention relates to dressing aids and more particularly pertains to a new undergarment dressing aid for aiding a user when putting on undergarments and lingerie with hard to reach fasteners.

2. Description of the Prior Art

The use of dressing aids is known in the prior art. More specifically, dressing aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,777,764; U.S. Pat. No. 4,926,502; U.S. Pat. No. Des. 285,621 by Green; U.S. Pat. No. 3,949,426; U.S. Pat. No. 3,392,730; and U.S. Pat. No. 5,060,315.

While these devices fulfill their respective, particular objectives and requirements, the aforementioned patents do not disclose a new undergarment dressing aid. The inventive device includes a tubular sleeve designed for wear around a user's torso and having inner and outer faces and open top and bottom ends.

In these respects, the undergarment dressing aid according to the present invention substantially departs from the conventional concepts and designs of the prior art, and in so doing provides an apparatus primarily developed for the purpose of aiding a user when putting on undergarments and lingerie with hard to reach fasteners.

SUMMARY OF THE INVENTION

In view of the foregoing disadvantages inherent in the known types of dressing aids now present in the prior art, the present invention provides a new undergarment dressing aid construction wherein the same can be utilized for aiding a user when putting on undergarments and lingerie with hard to reach fasteners.

The general purpose of the present invention, which will be described subsequently in greater detail, is to provide a new undergarment dressing aid apparatus and method which has many of the advantages of the dressing aids mentioned heretofore and many novel features that result in a new undergarment dressing aid which is not anticipated, rendered obvious, suggested, or even implied by any of the prior art dressing aids, either alone or in any combination thereof.

To attain this, the present invention generally comprises a tubular sleeve designed for wear around a user's torso and having inner and outer faces and open top and bottom ends.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new undergarment dressing aid apparatus and method which has many of the advantages of the dressing aids mentioned heretofore and many novel features that result in a new undergarment dressing aid which is not anticipated, rendered obvious, suggested, or even implied by any of the prior art dressing aids, either alone or in any combination thereof.

It is another object of the present invention to provide a new undergarment dressing aid which may be easily and efficiently manufactured and marketed.

It is a further object of the present invention to provide a new undergarment dressing aid which is of a durable and reliable construction.

An even further object of the present invention is to provide a new undergarment dressing aid which is susceptible of a low cost of manufacture with regard to both materials and labor, and which accordingly is then susceptible of low prices of sale to the consuming public, thereby making such undergarment dressing aid economically available to the buying public.

Still yet another object of the present invention is to provide a new undergarment dressing aid which provides in the apparatuses and methods of the prior art some of the advantages thereof, while simultaneously overcoming some of the disadvantages normally associated therewith.

Still another object of the present invention is to provide a new undergarment dressing aid for aiding a user when putting on undergarments and lingerie with hard to reach fasteners.

Yet another object of the present invention is to provide a new undergarment dressing aid which includes a tubular sleeve designed for wear around a user's torso and having inner and outer faces and open top and bottom ends.

Still yet another object of the present invention is to provide a new undergarment dressing aid that aids a user when putting on bras, corsets, bustiers, waist cinchers, and garter belts.

Even still another object of the present invention is to provide a new undergarment dressing aid that lets a user fasten rear fastening undergarments at the chest and then quickly slid around to position the fasteners at the back of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
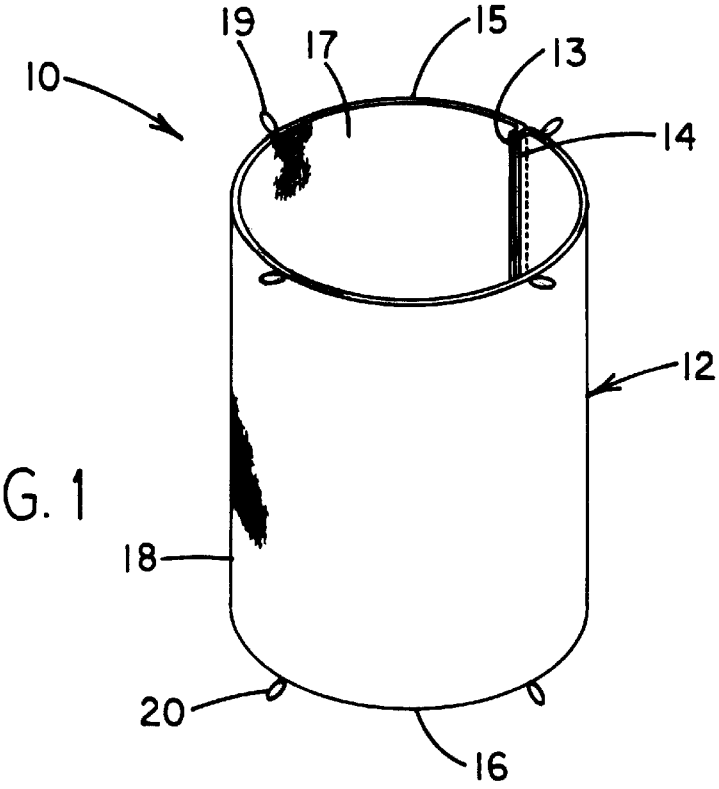
FIG. 1 is a schematic perspective view of a new undergarment dressing aid according to the present invention.

With reference now to the drawings, and in particular to FIGS. 1 through 5 thereof, a new undergarment dressing aid embodying the principles and concepts of the present invention and generally designated by the reference numeral 10 will be described.

As best illustrated in FIGS. 1 through 5, the undergarment dressing aid 10 generally comprises a tubular sleeve designed for wear around a user's torso and having inner and outer faces and open top and bottom ends.

In use, the undergarment dressing aid 10 is designed for aiding user when putting on a rear fastening undergarment 11 having rear fasteners located at a back region of the undergarment designed for positioning adjacent the back of the user. In closer detail, the undergarment dressing aid 10 comprises a generally rectangular elastic panel 12 having a pair of end edges 13,14 and a pair of side edges 15,16 extending between the end edges of the panel. The panel comprises an elastic fabric material such as the materials sold under the trade names LYCRA and SPANDEX. The panel has a length defined between the end edges of the panel and a width defined between the side edges of the panel. Preferably, the width of the panel is greater than about one-half the length of the panel. Ideally, the length of the panel is between about 42 inches to about 44 inches and the width of the panel is between about 23 inches and about 26 inches.

As illustrated in FIG. 1, the end edges of the panel are coupled together such that panel forms a tubular sleeve having inner and outer faces 17,18 with the side edges of the panel defining open top and bottom ends of the sleeve. The end edges of the panel each have an end portion inwardly extending from the inner face of the sleeve. The end portions are stitched together along their entire length between the side edges of the panel to couple the end edges of the panel together. Preferably, the top and bottom ends of sleeve formed by the side edges of the panel lie in substantially parallel planes to one another.

Preferably, the top and bottom ends of the sleeve each have a plurality of flexible finger loops 19,20 coupled thereto. The finger loops are preferably spaced apart along the associated end of the sleeve at generally equal intervals. Ideally, the top end of the sleeve has four finger loops coupled thereto and the bottom end of the sleeve has four finger loops coupled thereto.

Figure 2:
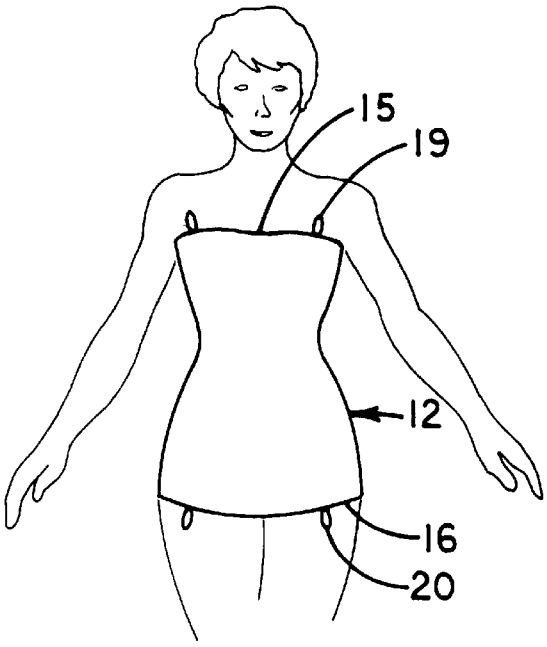
FIG. 2 is a schematic front view of the present invention on the torso of a user.

In use, the sleeve is first worn around the torso of a user such that the one of the ends of the sleeve is positioned adjacently below the armpits of the user and the other of the ends of the sleeve is positioned towards the waist of the user as illustrated in FIG. 2. The user may insert fingers and thumbs through the finger loops to provide a better grip on the sleeve when pulling of the sleeve to adjust the position of the sleeve on the torso of the user.

Figure 3:
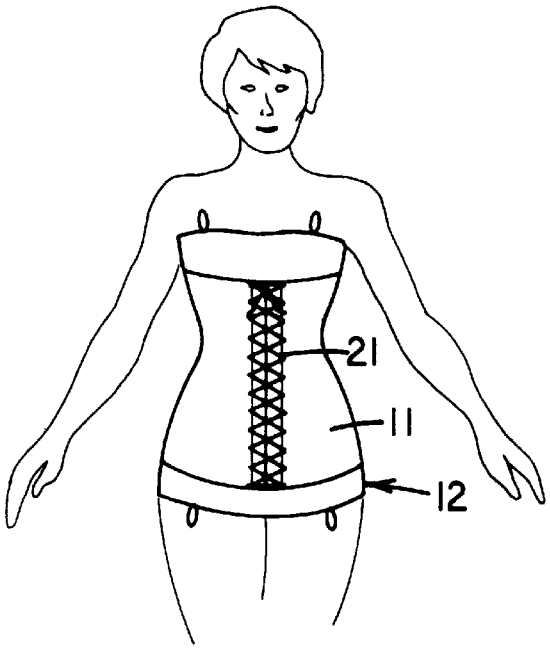
FIG. 3 is a schematic front view of the present invention in use with an undergarment placed over the sleeve on the torso of the user.

With reference to FIG. 3, the undergarment is then placed around the torso of the user over the sleeve so that the rear fasteners 21 of the undergarment are positioned adjacent the chest of the user. The rear fasteners are then fastened together to secure the undergarment around the torso of the user.

Figure 4:
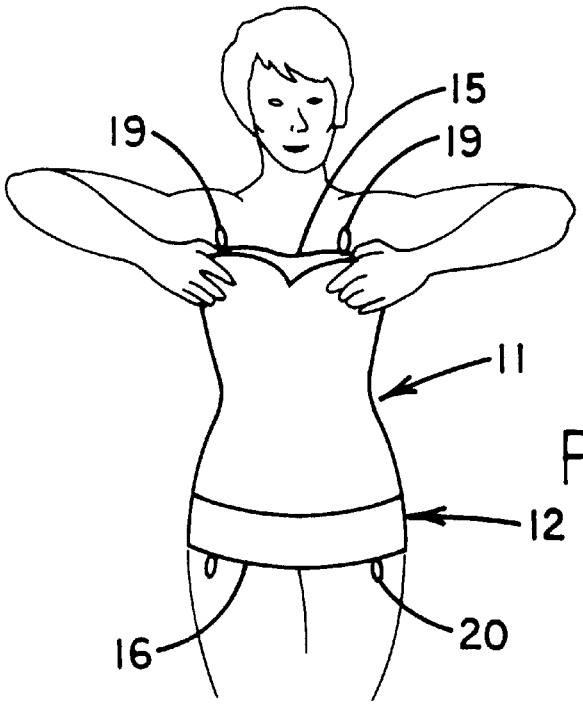
FIG. 4 is a schematic front view illustrating the turning of the undergarment on the torso of the user to position the rear fasteners of the undergarment on the back of the user.
Figure 5:
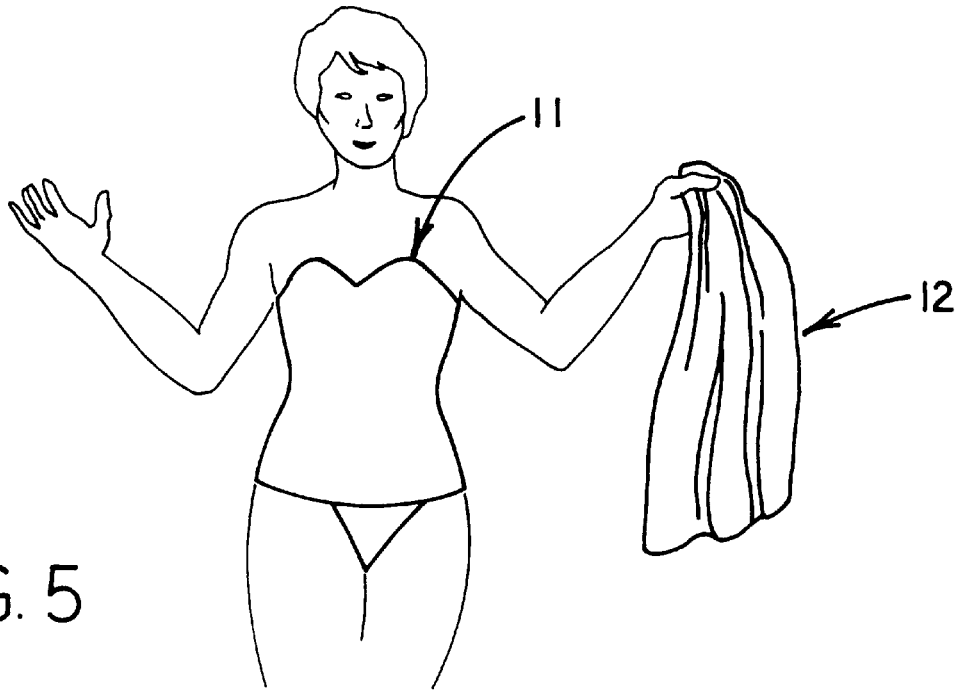
FIG. 5 is a schematic front view with the user pulling the sleeve out from underneath the undergarment and off of the user's torso.

With reference to FIG. 4, the undergarment is then rotated around the torso of the user so that the rear fasteners of the undergarment are positioned adjacent the back of the user. Next, the user pulls upwards or downwards on the one of the ends of the sleeve upwards or downwards to slide the sleeve out from underneath the undergarment and to remove the sleeve from the user as shown in FIG. 5. Ideally, the user inserts fingers or thumbs through the finger loops to provide a better grip on the sleeve when pulling of the sleeve when sliding the sleeve out from underneath the undergarment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An undergarment dressing aid for aiding the putting on of an undergarment, comprising:

a tubular sleeve adapted for wear around a user's torso and having inner and outer faces and open top and bottom ends, wherein the sleeve is comprised of an elastic panel having a surface with a coefficient of friction for facilitating the removal of said tubular sleeve from between the undergarment and the user's torso.

2. The undergarment dressing aid of claim 1, wherein said panel is generally rectangular and having a pair of end edges and a pair of side edges extending between said end edges of said panel, said end edges of said panel being coupled together to form said sleeve.

3. The undergarment dressing aid of claim 2, wherein said panel having a length defined between said end edges of said panel and a width defined between said side edges of said panel, wherein said width of said panel is greater than about one-half said length of said panel.

4. The undergarment dressing aid of claim 3, wherein said length of said panel is between about 42 inches to about 44 inches and said width of said panel is between about 23 inches and about 26 inches.

5. The undergarment dressing aid of claim 2, wherein said end edges of said panel each have an end portion inwardly extending from said inner face of said sleeve, said end portions being stitched together between said side edges of said panel to couple said end edges of said panel together.

6. The undergarment dressing aid of claim 1, wherein said top and bottom ends of said sleeve each have a plurality of flexible finger loops coupled thereto.

7. The undergarment dressing aid of claim 6, wherein said finger loops are spaced apart along the associated end of said sleeve at generally equal intervals.

8. A method of putting on an undergarment comprising the acts of:

providing an undergarment dressing aid comprising:

an elastic panel being generally rectangular and having a pair of end edges and a pair of side edges extending between said end edges of said panel, said panel comprising an elastic fabric material;

said panel having a length defined between said end edges of said panel and a width defined between said side edges of said panel;

wherein said width of said panel is greater than about one-half said length of said panel;

wherein said length of said panel is between about 42 inches to about 44 inches and said width of said panel is between about 23 inches and about 26 inches;

said end edges of said panel being coupled together such that panel forms a tubular sleeve having inner and outer faces, said side edges of said panel each defining open top and bottom ends of said sleeve;

said end edges of said panel each having an end portion inwardly extending from said inner face of said sleeve, said end portions being stitched together between said side edges of said panel to couple said end edges of said panel together;

said top and bottom ends of sleeve lying in substantially parallel planes to one another;

said top and bottom ends of said sleeve each having a plurality of flexible finger loops coupled thereto;

said finger loops being spaced apart along the associated end of said sleeve at generally equal intervals;

wherein said top end of said sleeve has four finger loops coupled thereto;

wherein said bottom end of said sleeve has four finger loops coupled thereto;

wearing said sleeve around the torso of a user such that said one of said ends of said sleeve is positioned adjacently below the armpits of the user and the other of said ends of said sleeve is positioned towards the waist of the user;

pulling on said sleeve to adjust the position of said sleeve on the torso of the user;

inserting fingers through said finger loops when pulling of said sleeve;

providing an undergarment having rear fasteners located at a back region of said undergarment adapted for positioning adjacent the back of the user;

placing said undergarment around the torso of the user over said sleeve so that the rear fasteners of the undergarment are positioned adjacent the chest of the user;

fastening the rear fasteners together to secure said undergarment around the torso of the user;

rotating the undergarment around the torso of the user so that said rear fasteners of said undergarment are positioned adjacent the back of the user;

pulling on said one of said ends of said sleeve upwards or downwards to slide said sleeve out from underneath said undergarment;

inserting fingers through said finger loops when pulling of said sleeve; and removing said sleeve off of the user.

9. A method of putting on an undergarment comprising the acts of:

providing an undergarment dressing aid comprising:

an elastic panel being generally rectangular and having a pair of end edges and a pair of side edges extending between said end edges of said panel, said panel comprising an elastic fabric material;

said end edges of said panel being coupled together such that said panel forms a tubular sleeve having inner and outer faces, said side edges of said panel each defining open top and bottom ends of said sleeve;

said top and bottom ends of said sleeve lying in substantially parallel planes to one another;

said top and bottom ends of said sleeve each having a plurality of flexible finger loops coupled thereto;

said finger loops being spaced apart along the associated end of said sleeve at generally equal intervals;

wherein said top end of said sleeve has a plurality of finger loops coupled thereto;

wherein said bottom end of said sleeve has a plurality of finger loops coupled thereto;

wearing said sleeve around the torso of a user such that said one of said ends of said sleeve is positioned below the armpits of the user and the other of said ends of said sleeve is positioned towards the waist of the user;

providing an undergarment having rear fasteners located at a back region of said undergarment adapted for positioning adjacent the back of the user;

placing said undergarment around the torso of the user over said sleeve so that the rear fasteners of the undergarment are positioned adjacent the chest of the user;

fastening the rear fasteners together to secure said undergarment around the torso of the user;

rotating the undergarment around the torso of the user so that said rear fasteners of said undergarment are positioned adjacent the back of the user; and pulling on said one of said ends of said sleeve upwards or downwards to slide said sleeve out from underneath said undergarment for removing said sleeve off of the user.

10. The method of claim 9 including inserting fingers of the user through said finger loops when pulling on said sleeve.

11. The undergarment dressing aid of claim 1 wherein the elastic panel is formed from a spandex material.

* * * * *